United States Patent [19]

Harris

[11] 4,037,990

[45] July 26, 1977

[54] COMPOSITE TURBOMACHINERY ROTOR

[75] Inventor: David J. Harris, Fairfield, Ohio

[73] Assignee: General Electric Company, Cincinnati, Ohio

[21] Appl. No.: 691,390

[22] Filed: June 1, 1976

[51] Int. Cl.[2] ..... F01D 5/32

[52] U.S. Cl. ..... 416/220 R; 416/135; 416/230; 416/241 A; 416/221

[58] Field of Search ..... 416/219–220, 416/221, 248, 239, 230, 241 A, 135

[56] References Cited

U.S. PATENT DOCUMENTS

| | | | |
|---|---|---|---|
| 2,559,131 | 7/1951 | Oestrich et al. | 416/220 X |
| 2,656,146 | 10/1953 | Sollinger | 416/221 X |
| 2,859,936 | 11/1958 | Warnken | 416/220 |
| 2,861,775 | 11/1958 | Whitehead | 416/220 |
| 2,868,439 | 1/1959 | Hampshire et al. | 416/220 X |
| 2,929,755 | 3/1960 | Porter | 264/161 |
| 2,936,155 | 5/1960 | Howell et al. | 416/135 X |
| 3,720,481 | 3/1973 | Motta | 416/207 X |
| 3,737,250 | 6/1973 | Pilpel et al. | 416/230 X |

FOREIGN PATENT DOCUMENTS

| | | | |
|---|---|---|---|
| 787,500 | 12/1957 | United Kingdom | 416/230 |
| 801,775 | 9/1958 | United Kingdom | 416/220 |

*Primary Examiner*—Everette A. Powell, Jr.
*Attorney, Agent, or Firm*—Robert C. Lampe, Jr.; Derek P. Lawrence

[57] ABSTRACT

A turbomachinery rotor comprising a rotatable hub and a composite blade attached to the periphery thereof. The blade comprises a plurality of bonded filament laminates extending between, and wrapped around, a pair of hollow, semicylindrical inserts at the blade root. The laminates are bonded to the inserts so as to form a cylindrical blade root profile for insertion into a complementary cylindrical groove in the periphery of the hub. A slotted pin is positioned within the inserts to prevent the root from collapsing under loadings and to retain the blade in the hub.

10 Claims, 4 Drawing Figures

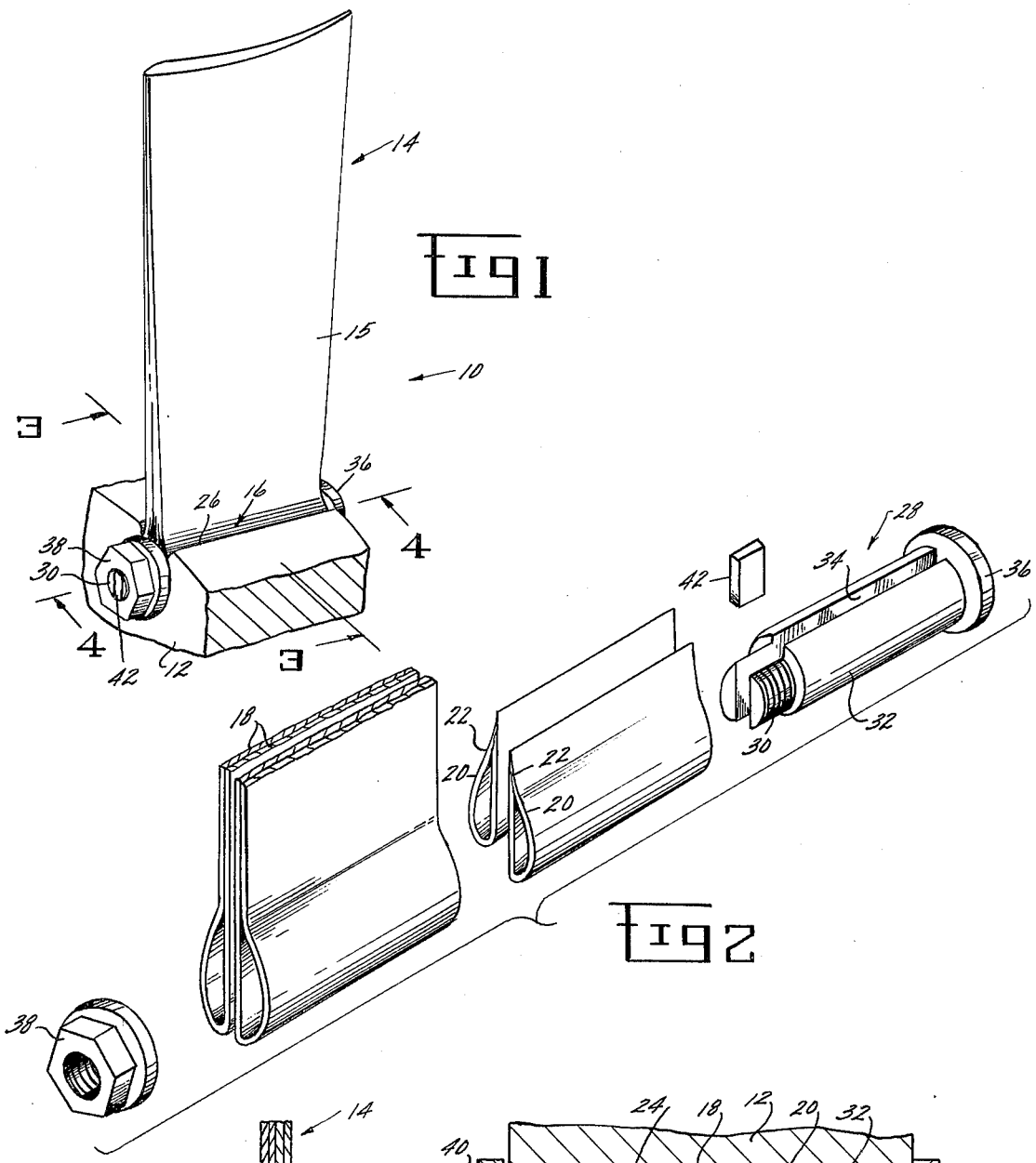
Fig 1
Fig 2
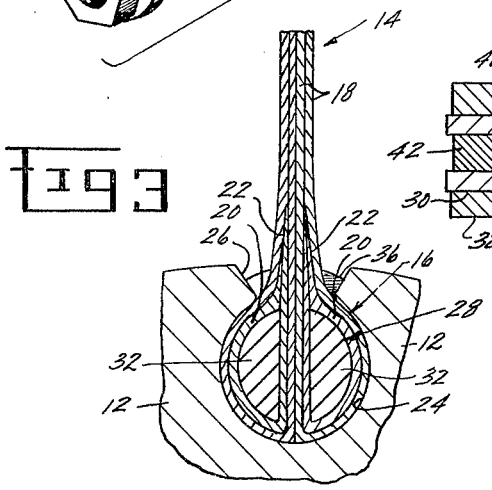
Fig 3
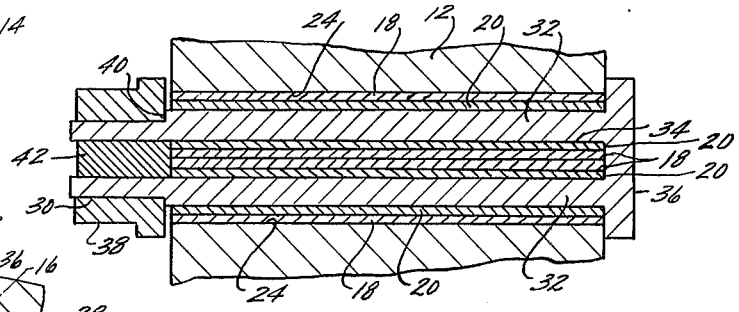
Fig 4

COMPOSITE TURBOMACHINERY ROTOR

BACKGROUND OF THE INVENTION

This invention relates to bladed rotors for use in fluid flow machines and, more particularly, to fabrication of a composite blade root for retention within the periphery of a rotatable hub.

The invention herein described was made in the course of or under a contract, or a subcontract thereunder, with the United States Department of the Air Force.

Significant advances have been made in replacing the relatively heavy, homogeneous metallic blades of turbomachinery with lighter composite materials. The primary effort in this regard has been toward the adoption of high strength (high modulus of elasticity) filaments composited in a lightweight matrix. Early work involved glass fibers, while recent efforts have utilized boron, graphite and other synthetic filaments which are capable of providing the necessary stiffness to the turbomachinery blades.

Many problems have confronted the efforts to utilize these filaments but, to a large extent, they have been overcome. However, at least one difficult problem remains to be solved, that being the design of a suitable connection capable of transmitting the blade gas, centrifugal and impact loads to a rotatable hub or disc. Dovetail attachments presently represent the most expeditious and reliable method of affixing the blades to the hub. For composite blades, this creates a difficulty in that composite filament structures are least effective at fiber transitions or edges.

Typically, a blade is formed of a plurality of sheets or laminates of collimated filaments embedded in a lightweight matrix, the sheets being appropriately contoured and laminated so as to form the desired airfoil structural shape. To form a dovetail at the blade root, several approaches have been taken. One approach is to splay the individual filament laminates to shape the dovetail and fill the voids therebetween with wedges of filler material to provide a dense, load-carrying capability. The problem is that, as mentioned previously, composite laminates abhor transitions or discontinuities and the resulting structure may tend to be weaker than desired at the transition into the dovetail region.

A second approach has been to bring the composite filament laminates down from the airfoil section tip, wrap them essentially 180° around a pin, and then route them back into the airfoil section. The wrapped pin is then inserted into a cylindrical aperture formed on the hub rim to retain the blade. The problem in this approach is that the laminates on the outside of the blade are forced to carry the majority of the blade loading, while the inner laminates contribute little, if anything, to the blade loadcarrying potential. However, the pin root concept offers an advantage over the splayed root in that the cylindrically shaped blade root is capable of rotation within its associated slot if the slot is appropriately relieved. This is an important characteristic when considering the foreign object impact tolerance of a blade, since it is much preferable to have a blade which will swing under lateral impact loads than one which is rigidly fixed and must be fabricated to withstand large lateral bending moments without filament fracture or delamination. Thus, a cylindrical root is preferable to any other shape in this regard.

SUMMARY OF THE INVENTION

Accordingly, it is a primary object of the present invention to provide a pin root composite turbomachinery blade with improved load-carrying capability.

It is another object of the present invention to provide a rotor having an improved attachment between a rotatable hub and a composite blade.

It is yet another object of the present invention to provide an easily replaceable composite turbomachinery blade.

These and other objects and advantages will be more clearly understood from the following detailed description, the drawings and specific examples, all of which are intended to be typical of rather than in any way limiting to the scope of the present invention.

Briefly stated, the above objects are accomplished in a turbomachinery rotor having a blade formed of bonded laminates of collimated, high strength filaments embedded in a lightweight matrix, wherein the laminates form a cylindrical root profile for the blade. In one embodiment, a pair of hollow, metallic inserts, each having a semicylindrical cross section, are provided at the root of the blade and half of the laminates are wrapped 180° in opposite directions around each insert and back into the airfoil portion of the blade. The laminates are bonded to the inserts, the arcuate surfaces of the inserts providing a cylindrical profile for the root. Actual attachment of the blade root to a rotatable hub is provided by inserting the root into a complementary slot on the hub rim, the slot being relieved at the entrance thereof to permit blade rotation under impact loads. A slotted bolt positioned within the inserts prevents the root from collapsing under the loadings and also prevents axial travel of the root with respect to the hub.

BRIEF DESCRIPTION OF THE DRAWINGS

While the specification concludes with claims particularly pointing out and distinctly claiming the subject matter which is regarded as part of the present invention, it is believed that the invention will be more fully understood from the following description of the preferred embodiments which is given by way of example with the accompanying drawings in which:

FIG. 1 is a partial perspective view of a turbomachinery rotor constructed in accordance with the present invention;

FIG. 2 is an enlarged, exploded, perspective view of the several elements of the rotor of FIG. 1;

FIG. 3 is a cross-sectional view taken along line 3—3 of FIG. 1; and FIG. 4 is a cross-sectional view taken along line 4—4 of FIG. 1.

DESCRIPTION OF THE PREFERRED EMBODIMENT

Referring to the drawings wherein like numerals correspond to like elements throughout, attention is first directed to FIG. 1 wherein the turbomachinery rotor 10 comprising a rotatable hub 12 and a blade 14, and constructed in accordance with the present invention is illustrated. While there are generally a plurality of such blades extending radially from hub 12, only one such blade is depicted herein for sake of clarity. While not so limiting, the blade 14 depicted herein is representative of those found in gas turbine engine compressors and fans and, accordingly, is shown to comprise an airfoil portion 15 of generally radially variant camber and stagger, and a root portion 16 which enables the blade to be mounted on and retained by the rotatable hub or disc 12.

Referring now to FIGS. 2 and 3, the airfoil portion of the blade is of the composite variety and is shown to comprise a plurality of laminates 18 of collimated, elongated filaments embedded in a lightweight matrix, the laminates being laid up and bonded together in generally parallel relationship to form the airfoil portion 15 of the blade in the usual manner of composite blade manufacture. While the number of laminates could number 50 or more, the number has been greatly reduced herein in the drawings for the sake of simplicity and for ease of explanation, and it is recognized that the number of laminates is in no way limiting to the inventive concepts disclosed herein. In a nonmetallic composite blade, the laminates would typically comprise elongated graphite filaments in an epoxy resin, though the present invention anticipates the use of any fiber embedded in any binder, such as an organic resin for its structure.

Continuing with FIGS. 2 and 3, a pair of metallic inserts 20 are provided having generally semicylindrical cross section. These inserts may be simply fabricated from sheet metal rolled and lapped over upon themselves at joints 22 to form a flange which may be tapered by grinding as shown in FIG. 3. The filament laminates 18 extend radially downward through the blade root and are split into two generally equal halves, one half being wrapped substantially 180 degrees around the arcuate surface of each insert 20. The laminates then extend back up into the blade to provide additional contour to the airfoil portion 15. An organic resin applied as a binder between the laminates, and between the laminates and inserts 20, is cured to form a unitized, generally cylindrical profile as indicated in FIG. 3. Since all of the laminates extend radially inwardly through the root of the blade they will all contribute generally equally to the load-carrying potential of the structure. Transitions and discontinuities have been eliminated from the root portion, thereby providing a stronger blade.

In order to attach the blade to a typical rotatable hub, each root 16 is inserted into a complementary, cylindrical slot 24 on the periphery of the hub. The entrance to slot 24 is relieved as at 26 to permit the blade to swing laterally under side impact loads, it being recognized that centrifugal force or laterally extending shrouds (not shown) will maintain the blade in a radial orientation during rotational operation.

A bolt 28 is provided with a threaded end 30 and a shoulder 32 of larger diameter. A slot 34 divides the bolt into two portions, one of which is placed within each hollow insert 20 so as to fill the void therein and prevent root collapse during high loading operation. Substantial axial movement of the blade with respect to the hub is prevented by an enlarged diameter bolt head 36 in cooperation with a threaded nut 38 on opposite sides of the hub. As best shown in FIG. 4, the length of shoulder 32 exceeds slightly the width of hub 12 such that when nut 38 is fully seated against shoulder 32 at the diameter step 40 it does not bind the blade to the hub, thereby permitting lateral movement of the blade as discussed previously. Plug 42 inserted within slot 34 at the threaded portion 30 prevents collapse thereof when the nut 38 is screwed thereon. Blade replacement is simplified in that removal of bolt 28 will permit the blade root to slide out of slot 24 in the hub.

It will be obvious to one skilled in the art that certain changes can be made to the above-described invention without departing from the broad inventive concepts thereof. For example, while the above discussion has been directed to blades of the nonmetallic composite variety, it is recognized that the laminates could comprise any metallic system such as boron filaments in an aluminum matrix. Furthermore, flow path defining platforms or shrouds could be wrapped around and bonded to the root of the blade so as to be entrapped between the root and the rotatable hub. It is intended that the appended claims cover these and all other variations in the present invention's broader inventive concepts.

Having thus described the invention, what is claimed as novel and desired to be secured by Letters Patent of the United States is:

1. A turbomachinery blade comprising an airfoil section fabricated of a plurality of bonded filament laminates and a pair of hollow inserts, each insert having a generally semicylindrical outer arcuate surface, and wherein said laminates extend from the airfoil section, pass between said inserts and then are divided into two portions, each portion being wrapped essentially 180° around the outer arcuate surface of one of said inserts before being led back into the airfoil section, thereby forming a generally cylindrical, rotatable root for the blade.

2. A turbomachinery rotor comprising:

a rotatable hub having a generally cylindrical groove in the periphery thereof; and a blade having an airfoil section fabricated of a plurality of bonded filament laminates and a pair of hollow inserts, each insert having a generally semicylindrical outer arcuate surface, and wherein said laminates extend from the airfoil section, pass between said inserts and then are divided into two portions, each portion being wrapped essentially 180° around the outer arcuate surface of one of said inserts before being led back into the airfoil section, thereby forming a generally cylindrical rotatable root for the blade, and wherein the root is received within the groove for rotation therein with respect to said hub.

3. The turbomachinery rotor as recited in claim 1 wherein the laminates comprise boron filaments embedded in an aluminum matrix.

4. The turbomachinery rotor as recited in claim 1 wherein the groove is relieved at the entrance thereof such that the entrance width exceeds the blade airfoil thickness thereby permitting circumferential station of the blade within the groove.

5. The turbomachinery rotor as recited in claim 1 wherein the laminates comprise a plurality of high strength, elongated filaments embedded in an organic resin binder.

6. The turbomachinery rotor as recited in claim 5 wherein the laminates comprise graphite filaments embedded in an epoxy resin binder.

7. A turbomachinery rotor comprising:

a rotatable hub having a generally cylindrical groove in the periphery thereof;

a blade having an airfoil portion and a root portion, said blade including a pair of laterally separated, hollow inserts, each having a generally semicylindrical arcuate surface; and a plurality of composite filament laminates extending from the airfoil portion to the root portion, said laminates passing between and bonded to said inserts wherein substantially half of said laminates are wrapped essentially 180° around the arcuate surface of each insert and back to the airfoil portion to provide a generally cylindrical profile to the root portion, and wherein the root portion is received within the groove; and bolt means having a head, a threaded end and a shoulder of larger diameter than the threaded end, the bolt having an axial slot extending from the threaded end and through the shoulder to separate the shoulder into two portions, each shoulder portion inserted within, and of substantially the same contour as, the hollow interior of one of said inserts.

8. The turbomachinery rotor as recited in claim 7 wherein the length of the shoulder portion exceeds the thickness of the hub at the groove.

9. The turbomachinery rotor as recited in claim 7 further comprising plug means inserted in the axial slot at the threaded end of the bolt means for preventing collapse thereof.

10. The turbomachinery rotor as recited in claim 9 further comprising a nut threaded onto said bolt means and cooperating with the head thereof to entrap the disc therebetween.

* * * * *

UNITED STATES PATENT AND TRADEMARK OFFICE

CERTIFICATE OF CORRECTION

PATENT NO. : 4,037,990

DATED : July 26, 1977

INVENTOR(S) : David J. Harris

It is certified that error appears in the above-identified patent and that said Letters Patent are hereby corrected as shown below:

Column 4, line 44, "claim 1" should be --claim 2--;
Column 4, line 47, "claim 1" should be --claim 2--;
Column 4, line 50, "station" should be --rotation--;
Column 4, line 52, "claim 1" should be --claim 2--; and
Column 5, line 3, "back to" should be --back into--.

Signed and Sealed this

*First* Day of *November 1977*

[SEAL]

*Attest:*

RUTH C. MASON
*Attesting Officer*

LUTRELLE F. PARKER
*Acting Commissioner of Patents and Trademarks*